United States Patent [19]

Etherington

[11] 4,101,253

[45] Jul. 18, 1978

[54] EXTRUSION

[75] Inventor: Clifford Etherington, Blackpool, England

[73] Assignee: United Kingdom Atomic Energy Authority, London, England

[21] Appl. No.: 749,444

[22] Filed: Dec. 10, 1976

Related U.S. Application Data

[60] Continuation of Ser. No. 671,031, Mar. 29, 1976, abandoned, which is a continuation of Ser. No. 541,089, Jan. 15, 1975, abandoned, which is a division of Ser. No. 388,139, Aug. 14, 1973, abandoned.

[30] Foreign Application Priority Data

Nov. 15, 1972 [GB] United Kingdom ..... 52830/72
Jan. 9, 1973 [GB] United Kingdom ..... 2968/73

[51] Int. Cl.[2] ..... B22F 3/18

[52] U.S. Cl. ..... 425/79; 425/224; 425/376 R

[58] Field of Search ..... 425/78, 79, 383, 392, 425/376, 223, 224, 447; 72/60, 253, 262, 270, 272, 272, 273, 263

[56] References Cited

U.S. PATENT DOCUMENTS 3,689,209 9/1972 Vinogradov et al. ..... 425/79

3,765,216 10/1973 Green ..... 425/224 X

*Primary Examiner*—Richard B. Lazarus

*Attorney, Agent, or Firm*—Larson, Taylor and Hinds

[57] ABSTRACT

Extrusion apparatus comprising a wheel having a circumferential groove around its outer edge. A fixed shoe member bearing against the edge of the wheel has a die member projecting into the circumferential groove. Material to be extruded is fed into the circumferential groove below the shoe member. The wheel is rotated relative to the shoe member so that the material is carried along the circumferential groove by frictional drag towards the die member and is extruded through an orifice in the die member. Conventiently the wheel is formed from three abutting discs, the center disc having a diameter less than that of the two outer discs whereby to form the circumferential groove.

The material to be extruded can be in the form of a metal powder. The wheel is arranged to rotate about a horizontal axis and the shoe member is disposed beneath the wheel whereby powder can be fed under gravity into the groove. The powder can be compacted into a continuous strip before entering into the groove between the shoe member and the wheel by arranging a driven roller to project into the groove in the wheel immediately in front of the shoe member.

4 Claims, 3 Drawing Figures

EXTRUSION

This is a continuation of application Ser. No. 671,031 filed Mar. 29, 1976, which in turn was a continuation of Ser. No. 541,089, filed Jan. 15, 1975, now abandoned which in turn was a divisional of Ser. No. 388,139, filed Aug. 14, 1973, also abandoned.

BACKGROUND OF THE INVENTION

The present invention relates to the forming of materials by extrusion.

U.S. Pat. Application Ser. No. 228,673 which has been assigned to the present Assignee discloses and claims an extrusion apparatus which comprises first and second members defining an elongate passageway therebetween, said first and second members being movable one relative to the other in the direction of the length of the passageway, an abutment member fixed relative to the second member projecting into and blocking the passageway, means defining at least one die orifice leading from the passageway adjacent the abutment member, said orifice extending from said passageway to a point outside said apparatus whereby material fed to said apparatus is extruded therethrough, means for continuously feeding material to be extruded from a position outside said apparatus into said passageway at a point spaced from the abutment member, the amount of the surface area of the passageway defined by the first member which is movable towards the abutment member being greater than the amount of the surface area of the passageway defined by the second member, whereby material fed into the passageway is moved by frictional drag with the surfaces of the passageway in the first member towards the abutment member and is thereby extruded through the die orifice.

The passageway can be formed by an endless groove in the first member with the second member being in the form of a shoe covering a part of the length of the groove. The shoe is positioned as close as possible to the first member and over the groove in the first member.

Conveniently the first member can be a wheel member and preferably the endless groove is formed in the peripheral edge of the wheel member.

Experience has shown that the wheel member can develop fatigue failure arising from fluctuating stresses therein upon rotation of the wheel member to extrude material. The stresses reach a maximum in that portion of the wheel member immediately in front of and adjacent the abutment member, falling to a minimum in that portion of the wheel member to the rear of the abutment member. This continued stress cycling during rotation of the wheel member can eventually result in failure and fracture of the wheel member.

SUMMARY OF THE INVENTION

To overcome this possible weakness it is proposed, according to one feature of the present invention, to form the wheel member from three abutting discs, the centre disc having a diameter less than the diameter of the abutting outer discs whereby to form the groove for the reception of the abutment member and the material to be extruded.

Stress concentration appears at the corners of the groove and by forming the wheel member in three parts the stress concentration is diminished resulting in a prolonged life for the wheel member. Conveniently the discs are keyed or splined on to a shaft for rotation and means can be provided for pressure loading the two outer discs in opposite directions axially of the shaft in order to maintain the discs in abutting relationship.

The material to be extruded can be a metal in the form of a powder or other loose material and compaction of the powder can occur as the powder is dragged through the passageway upon relative movement between the first and second members.

According to another feature of the present invention there is provided means co-operable with the first member to compact a powder or other loose material into a continuous strip prior to entering the passageway.

Thus a nip for compacting powder and like loose material can be formed between the movable first member and a driven member at the entrance to the passageway between the movable first member and the second member.

The movable first member can be a wheel having an endless circumferential groove therein and the wheel can be formed from abutting discs as hereinabove disclosed. The driven member can conveniently be a roller the rim or a peripheral lip of which extends into the circumferential groove in the wheel.

DESCRIPTION OF THE DRAWINGS

The invention will be described further, by way of example, with reference to the accompanying drawings; in which.

DESCRIPTION OF THE PREFERRED EMBODIMENTS

Figure 1:
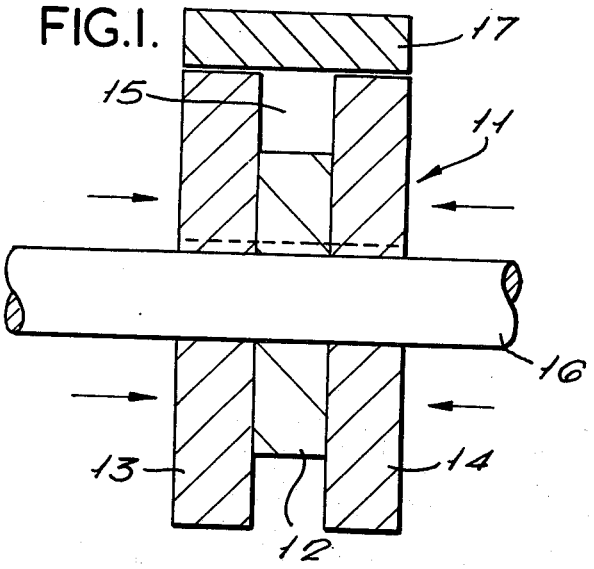
FIG. 1 is a diagrammatic section through a wheel member formed from abutting discs.
Figure 2:
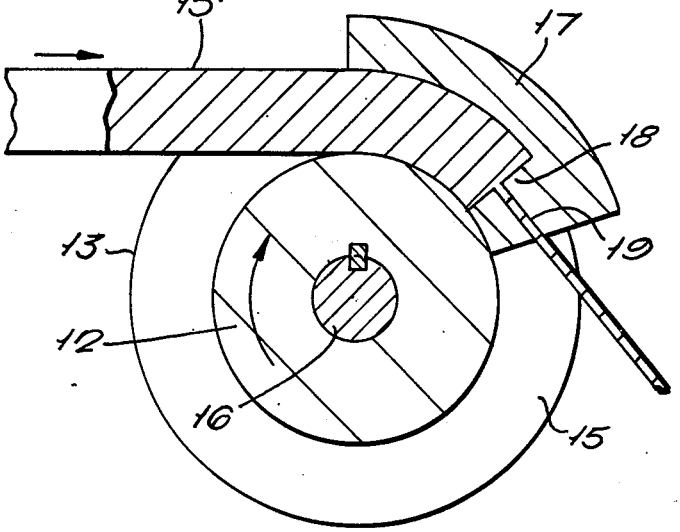
FIG. 2 is a sectional elevation of the wheel member shown in FIG. 1.

FIGS. 1 and 2 show a wheel member 11 formed from three abutting discs. The diameter of the centre disc 12 is less than the diameters of the outer discs 13 and 14 so as to define a continuous peripheral groove 15 about the wheel member. The discs are splined or keyed for rotation to a drive shaft 16. Means, not shown, are provided for maintaining the discs in abutting relationship. For example the discs can be held together by oppositely inwardly acting compressive forces on the outer faces of the discs 13 and 14 and as indicated schematically by arrows in FIG. 1.

The illustrated wheel member can replace the wheel member disclosed in U.S. Pat. Ser. No. 228,673 and the function and operation of the three part wheel is identical to that of the wheel member in the above mentioned patent application. Thus a shoe member 17 is arranged about a portion of the periphery of the wheel member 11 to enclose a length of the groove 15 and to define a passageway to receive material, such as metal stock 15', to be extruded. As disclosed in the above mentioned Pat. Ser. No. 228,673 the shoe member is formed with an abutment 18 to block one end of the passageway and one or more die orifices 19 are associated with the abutment.

As a result of being formed from three separate discs the wheel member is less prone to fatigue failure than is the case of a one part wheel member having a peripheral groove.

Figure 3:
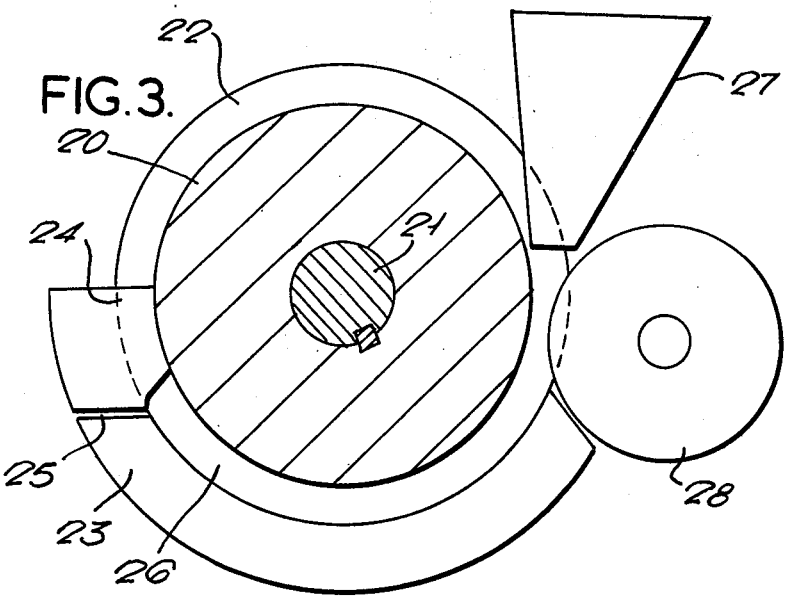
FIG. 3 is a diagrammatic representation of an extrusion apparatus for receiving powder feed.

FIG. 3 is a diagrammatic representation of an apparatus for the extrusion of powder and the like feed material.

The apparatus comprises a wheel member 20 splined or keyed to a horizontal drive shaft 21. The circumferential edge of the wheel member is formed with a continuous groove 22 which can be of square or rectangular cross-section. A fixed shoe member 23 is arranged about a lower portion of the circumferential edge of the wheel member. An abutment member 24 formed on the shoe member projects into the groove 22 in the wheel member and is complementary in shape to the groove cross-section so as to block the groove with a sliding fit. At least one extrusion orifice 25 is associated with the abutment member, that is, the or each orifice can be formed in the abutment member or alternatively can be formed in the shoe member immediately in front of the abutment member. An enclosed passageway 26 is thus provided between the wheel member and the shoe member, the passageway being blocked at one end by the abutment member 24 and open at its opposite end. When a material is introduced into the enclosed passageway and the wheel member is rotated in a direction to drag the material through the passageway towards the abutment member, the pressure generated in the material is such that the material can be extruded through the orifice or orifices associated with the abutment member.

The material introduced into the passageway can be a powder which is fed through a hopper 27 or like means. The feed can be continuous or intermittent and upon entering the passageway the powder will be compacted and a continuous length of wire will be extruded through the die orifice or orifices.

It may be advantageous to compact the powder into a "green" compact before it enters the passageway. This can be achieved by disposing a driven roller 28 immediately in front of the open end of the passageway with the rim of the roller engaging within the circumferential groove 12 in the wheel member. The degree of compacting achieved by the nip so formed between the walls of the groove and the periphery of the driven roller can be adjusted by radial displacement of the rim of the driven roller within the groove.

A continuous strip of the compacted powder emerges from the nip into the passageway between the wheel member and the shoe member.

Conveniently with the wheel member mounted for rotation on a horizontal axis, the shoe member is disposed beneath the wheel member to co-operate with a lower peripheral portion of the wheel member. The open end of the passageway is preferably located at or slightly below the horizontal plane through the axis of rotation so that the powder to be compacted can be gravity fed to the nip situated immediately in front of the open end of the passageway.

The above refers to the feeding of a powder but it is possible to compact other forms of loose material into a strip. Thus swarf from a machining process or discrete lengths of metal feed can be fed into the nip between the driven roller and the groove in the wheel member.

I claim:

1. Extrusion apparatus comprising a wheel member having an endless groove therein, a shoe member covering part of the length of the groove and forming a passageway therewith, an abutment member projecting into the groove and blocking one end of the passageway, the wheel member being rotatable relative to the shoe member in the direction towards the abutment member, at least one die orifice at least near the abutment member, and means for feeding loose feed material to be extruded into the end of the passageway remote from the abutment member so that the material is carried along in the groove by frictional drag in the direction towards the abutment member and is thereby extruded through the die orifice, and in which a rotary driven compacting member is arranged closely adjacent said shoe at said end of the passageway remote from the abutment to cooperate with the groove in the wheel member to form a nip for compacting the loose feed material into a continuous strip prior to entering the passageway, and means for driving said driven member.

2. Extrusion apparatus according to claim 1 in which the first member is a wheel having an endless circumferential groove and the driven member is a roller the rim of which projects into and cooperates with the groove to form the nip immediately in front of the open end of the passageway.

3. Extrusion apparatus according to Claim 2 including means for introducing loose feed metallic material under gravity into the nip.

4. Extrusion apparatus according to Claim 1 wherein at least one said die orifice is located in said abutment member.

* * * * *